United States Patent [19]

Larkey

[11] Patent Number: 4,978,121

[45] Date of Patent: Dec. 18, 1990

[54] PORTABLE PITCHING PRACTICE SYSTEM

[76] Inventor: Roger Larkey, 2110 S.W. 22nd, Perryton, Tex. 79070

[21] Appl. No.: 512,312

[22] Filed: Apr. 23, 1990

[51] Int. Cl.[5] ..... A63B 63/00

[52] U.S. Cl. ..... 273/26 A; 273/26 R

[58] Field of Search ..... 273/26 R, 26 A, 29 A, 273/177 A, 177 B, 179 R, 181 R, 181 A, 181 D, 181 K, 182 R, 348, 407, 408, 410

[56] References Cited

U.S. PATENT DOCUMENTS

| | | | |
|---|---|---|---|
| 1,170,715 | 2/1916 | Westgate | 273/26 A |
| 1,745,201 | 1/1930 | Alston | 273/181 R |
| 2,059,365 | 11/1936 | King | 273/26 A |
| 2,657,058 | 10/1953 | Mulchay | 273/26 A |
| 3,156,471 | 11/1964 | Biblean | 273/182 R |
| 3,194,556 | 7/1965 | Vinson | 273/26 A |
| 3,411,788 | 11/1968 | Blanding | 273/26 R |
| 3,656,750 | 4/1972 | Lee | 273/26 A |
| 3,810,616 | 5/1974 | Murphy | 273/26 A |
| 4,861,027 | 8/1989 | Thaxton | 273/26 A |

*Primary Examiner*—Theatrice Brown

*Attorney, Agent, or Firm*—L. Arnold Thaxton

[57] ABSTRACT

A portable baseball and/or softball pitching practice system for a pitcher. The practice system includes a pitching target with ball capture and collector means, and a removable target screen having a visual display painted on the screen. The pitching target is connected by a measuring cord to a pitcher's mound. The measuring cord functions to assist the pitcher in establishing a regulated and standard distance from target-to-pitcher. The pitcher's mound is equipped with training indicators that include a rearwardly located embossed rubber bar, a set of forwardly situated Velcro stripes, and a footprint insignia situated on top of the Velcro stripes.

12 Claims, 2 Drawing Sheets

PORTABLE PITCHING PRACTICE SYSTEM

FIELD OF THE INVENTION

This invention relates to a portable ball-pitching device and accompanying pitcher's mound, designed to cooperate as a practice pitching system. It is intended that both professional and amateur pitchers will find the inventive pitching system beneficial to their practicing efforts.

BACKGROUND OF THE INVENTION

When a baseball or softball pitcher prepares to practice pitching techniques, the pitcher ordinarily arranges for some one to catch the ball. Such an arrangement, by the pitcher, (a) limits practice time, (b) determines when a pitcher can practice, and (c) involves two people in an exercise that principally heightens the athletic skill of only one of them, namely, the pitcher. Experience directs this inventor to appreciate that pitchers ought to practice under circumstances that most nearly simulate actual game pitching to the exclusion of the dependency on others to do so. In this regard, it is a requirement of particular significance that the pitcher position himself at a regulated distance from the pitching target. Such a reqirement is easily met when the pitcher has access to a regularly structured ball field, where home plate and pitcher's mound is well established. Clearly, such an arrangement permits a single pitcher to operate for a period of time and usually to the inconvenience to other ball players whose game skills are also demanding of refinement. Of equal importance to the pitcher's delivery of the ball into the target zone is his technique or body motion on the mound. The pitcher's body stance, feet position, and pitch-follow-through are as important as the type of pitch he is attempting to deliver. The practicing pitcher needs to be constantly aware of his body movements prior to and after ball delivery to the target zone.

To some degree the prior art has been cognizant of such practice problems in the industry as is reflected in U.S. Pat No. 3,172,661 which issued on Mar. 9, 1965 to E. Scheemaeker. The patentee discloses a backstop target that can also retain captured balls thrown thereat. L. Poitras, in U.S. Pat. No. 4,830,369 and issuing on May 16, 1989, discloses a baseball pitching target that is easily transported.

It will be noted that the target device disclosed in the U.S. Pat. No. '661 is provided with a relatively small ball-retaining receptacle. On the other hand, the target device set forth in the U.S. Pat. No. '369 has no ball-retaining receptacle at all. Moreover, neither of the patented devices disclose a cooperating pitcher's mound, so vital to the developement of one's total pitching skills.

The practice pitching system of the present invention simplifies the practice process for the pitcher by supporting a more total and inclusive pitching technique, and is useful to those individuals who perform as baseball or softball pitchers. With the use of sound judgment, the pitching target and cooperating mound of this invention, may be installed anywhere. The inventive and readily mobile target with cooperating mound is indicative that the practicing pitcher (1) does not have to tie-up a baseball diamond to the expense to teammates, (2) is not constrained by time at practice, (3) does not require another individual to serve as a ball catcher, and (4) is better able to appreciate his body motion whether or not a live pitch is thrown. Further, several pitchers, requiring practice, may use other of the same units to this invention.

Accordingly, it is a general object of this invention to provide a portable, self-sufficient, and inexpensive pitcher's practicing target and cooperating mound for use by a single performer.

It is particularly an object of the present invention to provide a portable pitcher's practicing target having receptacle means for capturing and retaining thrown balls.

It is a further object of the present invention to provide a pitcher's practicing target having means to inhibit thrown balls from rebounding out of the capture target.

It is an additional object of the present invention to provide an instructive pitcher's mound, in cooperation with the practicing target, such that the pitcher is inspired to remain fully aware of all elements related to the proper pitching techniques.

SUMMARY OF THE INVENTION

The present invention has been developed with a view toward providing a baseball or softball pitcher with a pitching practice system that consists of a portable practice target that cooperates with a pitching mound equipped with training indicators. The pitching practice system, of this invention, can be used conveniently in circumstances where a pitcher desires to develope and critique his total pitching skills, to the absence of support by individual batters, catchers, fielders and the like. The pitching target is equipped with retractable rear wheels and, when tilted, is easily rolled about. The front portion of the pitcher's mound is connected by a cord to the bottom front of the practice target, and is similarly moved with facility. This pitching practice system is designed to elevate the performer's sense of connectedness with respect to ball preparation, body motion, and ball delivery, the three basic elements of a successful pitch.

A better understanding of the subject invention will be enabled when the following written description is read in conjunction with the appended drawings.

DESCRIPTION OF THE PREFERRED EMBODIMENT

Figure 1:
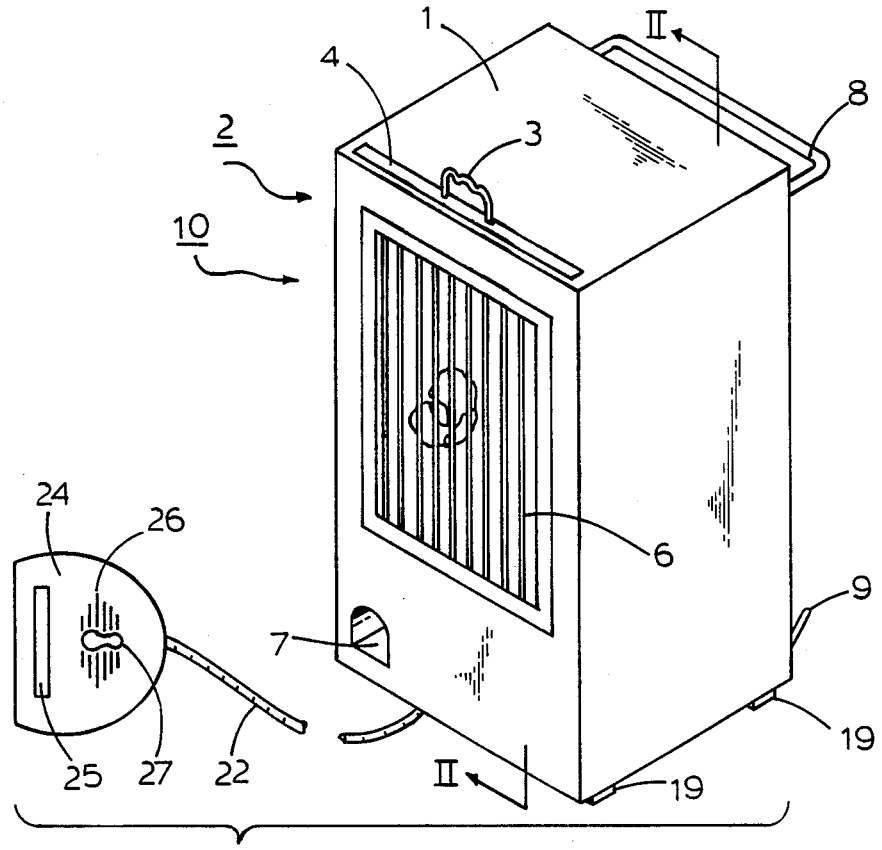
FIG. 1 is a front perspective view of a practice pitching target in cooperation with a top plan view of the pitcher's mound embodying the present invention.

Referring now to the drawings, wherein like numerals refer to like parts throughout the several views, and in particular to FIG. 1, wherein there is illustrated unit 10 comprising a rigid rectangular shape pitching-target housing 1 together with the attached portable pitcher's mound 24. Housing 1 of the present invention is made from a high impact resistant polymeric material of fiberboard and includes an insertable and removable target screen 2 disposed in a window centrally located at the upper front portion of housing 1. Handle 3 is attached to rod 4 of screen 2 and is provided to facilitate the insertion and removal of screen 2 from the front top of housing 1 whenever the occasion demands. At the front and extreme lower left portion of housing 1, aperture 7 is provided for the purpose of retreiving collected baseballs or softballs. Handlebar 8 is attached at the top rear of housing 1 to assist the operator in moving unit 10 for a selected purpose. Housing 1 further consists of lever 9, at its rear and lower end, which is used to raise or lower a pair of retractable wheels to be discussed hereinafter in reference to FIGS. 2 and 4. Plastic or rubber stoppers 19 are attached to the bottom end of housing 1 and function essentially to engage the ground surface after the unit 10 has been placed on location.

Cord 22, which is delimited by inch and foot measurements, has a first end centrally attached to the front exterior floor portion of housing 1. The second end of cord 22 is centrally secured to pitcher's mound 24 by means of a pickup reel 23 (not shown). Reel 23 is recessed on the underside of mound 24 to avoid interference of the pitcher's performance. Mound 24 comprises a rearwardly embossed rubber bar 25, on which the pitcher places his pivotal foot. A series of parallel Velcro stripes 26 are intermediately positioned between bar 25 and the front apex of mound 24. Stripes 26 function to hold a detachable footprint insignia 27 in place. Insignia 27 may consist of a fabric material such as cotton, a polyester, or the like. It is contemplated that each practicing pitcher position insignia 27 onto stripes 26 in such a manner that his free foot will land on insignia 27 after the pitch has been released. A few warm-up or simulated pitches will enable each individual performer to determine a comfortable position for insignia 27. In the development of positive pitching skills, each pitcher learns that he must place his free foot onto insignia 27 in order to deliver a successful pitch to target screen 2. Exemplary, the practicing pitcher will favorably appreciate that when his free foot lands immediately to the right of insignia 27, the pitch to screen 2—in baseball parlance—will effect an "inside" pitch. Conversely, when the pitcher's free foot lands slightly to the left of insignia 27, the pitcher will achieve an "outside" pitch to screen 2. Thus, the pitcher is provided with a permanent teaching tool that enables him to evaluate his pitching habits and rhythm in adherence to proven and standard pitching techniques. The practicing pitcher can immediately determine if his free foot has landed on insignia 27, as it appropriately should.

Since cord 22 is delimited in foot and inch measurements, in the fashion of a measuring tape, the operator or pitcher can position mound 24 at a standard pitching distance from housing 1, or, alternatively position mound 24 at some other distance therefrom.

Figure 2:
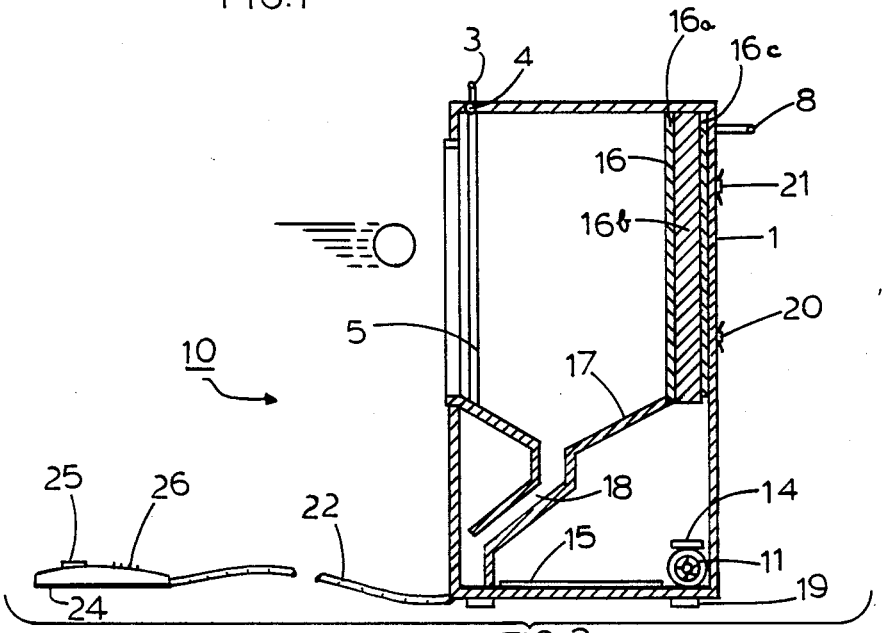
FIG. 2 is a side sectional view of my practice pitching target, taken along plane II—II of FIG. 1, in cooperation with a side elevational view of the pitcher's mound.
Figure 4:
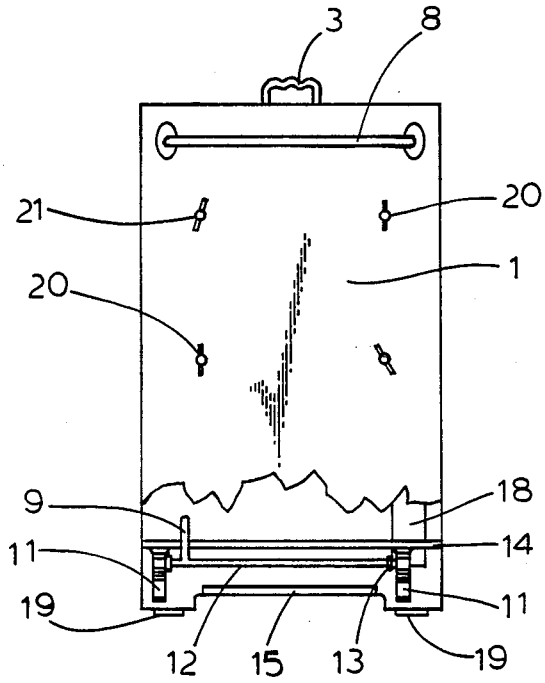
FIG. 4 is a rear elevational view of a practice pitching target embodying the present invention with a lower portion of the rear panel broken away.

Considering FIGS. 2 and 4 together, it is shown that housing 1, at the upper inside rear wall, is equipped with a rectangular shape, energy absorbing impact stop or panel 16. Panel 16 is comprised of an exterior layer or covering 16*a* made of leather or a flexible resinous material, an inner layer 16*b* of padding material, and a rear mounting board 16*c*. Impact panel 16 is secured to the inner and upper rear wall of housing 1 by means of screw type fasteners 20 which are engaged by butterfly nuts 21 at the outside rear of housing 1. Immediately beneath target screen 2 on the front end, and panel 16 at the rear end, housing 1 is provided with a funnel type ball trap 17 that is contiguous with a narrower chute 18 where the balls are collected until removed at aperture 7. Since aperture 7 is located slightly above the flooring of housing 1, a lip is produced at the juncture of the floor and the bottom end of aperture 7. This lip construction effects the retention of thrown and captured balls until manually removed from aperture 7. Situated at the rear floor of housing 1 is a pair of retractable wheels 11. When lever 9 is pressed down, the double brace 13 which is connected to bar 14 at one end and to lever bar 12 at the other end raises the rear of housing 1 so that the operator may roll the unit about. When lever 9 is lifted, wheels 11 are withdrawin into the bottom of housing 1. In order to prevent inadvertent moving or creeping of the practice target due to the force of thrown pitches, the floor of housing 1 is disposed with a fixed flat weight 15.

Figure 3:
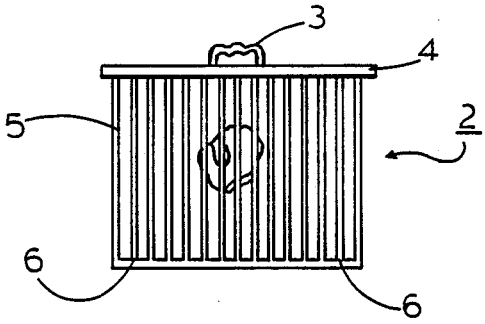
FIG. 3 is a front elevational view of a pitching target screen shown in FIG. 1.

FIG. 3, which illustrates that the target screen 2 removed from housing 1 is comprised of a rigid frame made of metal or plastic. The frame consists of a U-shaped member 5 that is intermediately attached to the bottom side of rod 4. Suspended within the boundary of U-shaped member 5, while attached only to the underside of rod 4, is a plurality of flexible plastic or leather stripes 6. Plural stripes 6 are arranged in a side-by-side abutment, one to the other. It is envisioned that stripes 6 display a visual target as shown in FIG. 3. Stripes 6 are easily puched aside by a thrown ball that continues its flight path until contact is encountered with panel 16. On the other hand, stripes 6 offer escape resistance to a fast ball whose energy is not entirely absorbed by panel 16, and thus, assists in preventing the ball from rebounding onto the ground. Centrally painted on stripes 6 is a visual target image such as a catcher's glove for which the pitcher should aim. In the alternative, other target screens may have a home plate or fielder's glove painted on stripes 6.

In compliance with the statues so governoring, the invention has been set forth in language more or less specific in accounting for structural, functional, and component features. However, it is understood that the invention is not limited to the specific features shown but that means and construction herein disclosed comprise a preferred form of executing the invention, while numerous modifications of the disclosed embodiments will undoubtedly occur to those of skill in the art, such modifications are deemed pertinent to the spirit of the invention. The scope of this invention is to be limited solely in light of the appended claims.

I claim:

1. A portable baseball and softball pitcher's practice device comprising:

a rigid housing having vertically top, bottom, front, rear and side walls, said front wall having an opening at an upper portion thereof, a ball penetrating target screen supported by a rigid frame, said frame being placed about said opening such that a ball propelled through said opending will pass through said screen and into said housing, a ball impact energy absorbing panel within said housing attached to said rear wall adjacent said opening and target screen whereby a ball passing through said screen will impact against said energy absorbing panel, a hollow ball collecting trap within said housing and positioned below said screen and said energy absorbing panel, said trap having upper and lower ends and configured to receive and discard a ball rebounding from said pad, said front wall having a further opening therein adjacent a lower end portion thereof, said further opening communicating with said trap lower end whereby a ball impacting said pad will fall into said trap and exit said housing at said further opening, means defining a pair of retractable wheels, said wheels being attached to a lower portion of said housing, a portable pitcher's mound and a cord of predetermined length, said cord having one of its ends attached to said pitcher's mound and its other end attached to said housing means attached to said cord for adjusting the effective length thereof, and means on said pitcher's mound to identify proper placement of a pitcher's feet.

2. The pitcher's practice apparatus as defined in claim 1, wherein said target screen in comprised of a plurality of flexible plastic strands supported by said frame in a side-by-side relationship such that they will allow balls to pass therebetween when said ball is thrown by a pitcher but will prevent balls from passing after the ball rebounds from said energy absorbing pad.

3. The pitcher's practice device as defined in claim 1, wherein said trap is substantially funnel shaped, the large end of said trap being attached to said wall adjacent said opening and said pad and the small end of said trap being attached adjacent said further opening at the lower portion of said front wall whereby balls leaving said trap will be returned towards said pitcher's mound.

4. The pitcher's practice device as defined in claim 1, wherein said housing is provided with handle means.

5. The pitcher's practice device as defined in claim 2, wherein said target screen is provided with indicia representing a catcher's glove.

6. The pitcher's practice device as defined in claim 1, wherein said card is provided with means whereby a player can detemine a particular distance said pitcher's mound is from said housing.

7. The pitcher's practice device as defined in claim 6, wherein said pitcher's mound has a pitcher's rubber adjacent a rear portion thereof and a footprint insignia placed adjacent a front portion thereof, said insignia having adjustment means whereby said insignia can be adjusted between said front portion and said pitcher's rubber.

8. The pitcher's practice device as defined in claim 7, wherein said adjustment means is a hook and loop material attached to and between said insignia and said pitcher's mound.

9. The pitcher's practice device as defined in claim 1, wherein said trap is funnel shaped, said upper end being larger than said lower end.

10. The pitcher's practice device as defined in claim 1, wherein handle means is attached to said wheels for manually extending and retracting said wheels.

11. The pitcher's practice device as defined in claim 1, wherein said opening is provided in said top wall adjacent said front wall, said frame being removably received into said opening.

12. The pitcher's practice device as defined in claim 1, wherein said frame is provided with handle means whereby said frame can be manually removed and inserted into said top opening.

* * * * *